US005673024A

United States Patent [19]

Frederick et al.

[11] Patent Number: 5,673,024

[45] Date of Patent: Sep. 30, 1997

[54] ELECTRONIC ARTICLE SURVEILLANCE SYSTEM WITH COMB FILTERING BY POLYPHASE DECOMPOSITION AND NONLINEAR FILTERING OF SUBSEQUENCES

[75] Inventors: Thomas J. Frederick, Coconut Creek; Dale R. Bettine, Coral Springs, both of Fla.

[73] Assignee: Sensormatic Electronics Corporation, Deerfield Beach, Fla.

[21] Appl. No.: 635,697

[22] Filed: Apr. 22, 1996

[51] Int. Cl.[6] ..... G08B 13/24

[52] U.S. Cl. ..... 340/572; 340/551

[58] Field of Search ..... 340/572, 551

[56] References Cited

U.S. PATENT DOCUMENTS

| | | | |
|---|---|---|---|
| 4,660,025 | 4/1987 | Humphrey | 340/572 |
| 4,859,991 | 8/1989 | Watkins et al. | 340/572 |

OTHER PUBLICATIONS

P.P. Vaidyanathan, "Multirate Digital Filters, Filter Banks, Polyphase Networks, and Applications: A Tutorial," *Proceedings of the IEEE*, vol. 78, No. 1, Jan. 1990, pp. 56–93.

Maragos, et al., "Morphological Filters—Part I: Their Set-Theoretic Analysis and Relations to Linear Shift—Invariant Filters," *IEEE Transactions on Acoustics, Speech, and Signal Processing*, vol. ASSP-35, No. 8, Aug. 1987, pp. 1153–1169.

Maragos, et al., "Morphological Filters—Part II: Their Relations to Median, Order-Statistic, and Stack Filters," *IEEE Transactions on Acoustics, Speech, and Signal Processing*, vol. ASSP-35, No. 8, Aug. 1987, pp. 1170–1184.

Yin et al., "Fast Adaptation and Performance Characteristics of FIR-WOS Hybrid Filters," *IEEE Transactions on Signal Processing*, vol. 42, No. 7, Jul. 1994, pp. 1610–1628.

Haweel, et al., "A Class of Order Statistic LMS Algorithms," *IEEE Transactions on Signal Processing*, vol. 40, No. 1, Jan. 1992, pp. 44–53.

Wendt, et al., "Stack Filters," *IEEE Transactions on Acoustics, Speech, and Signal Processing*, vol. ASSP-34, No. 4, Aug. 1986, pp. 898–911.

Barner, et al., "Permutation Filters: A Class of Nonlinear Filters Based on Set Permutations," *IEEE Transactions on Signal Processing*, vol. 42, No. 4, Apr. 1994, pp. 782–798.

Heinonen, et al., "FIR-Median Hybrid Fiters," *IEEE Transactions on Acoustic, Speech, and Signal Processing*, vol. ASSP-35, No. 6, Jun. 1987, pp. 832–838.

*Primary Examiner*—Glen Swann

*Attorney, Agent, or Firm*—Robin, Blecker, Daley & Driscoll

[57] ABSTRACT

A signal received in an electronic article surveillance system is subjected to a nonlinear comb filtering function to remove interference. The nonlinear comb filtering is provided by performing a polyphase decomposition of an input digital signal, nonlinear filtering of the resulting subsequences, and then synthesizing the nonlinear-filtered subsequences. A median filter may be used as the subsequence filtering function. A linear comb filtering function may be provided downstream from the nonlinear comb filter to provide additional attenuation of interference.

31 Claims, 8 Drawing Sheets

ELECTRONIC ARTICLE SURVEILLANCE SYSTEM WITH COMB FILTERING BY POLYPHASE DECOMPOSITION AND NONLINEAR FILTERING OF SUBSEQUENCES

FIELD OF THE INVENTION

This invention is related to electronic article surveillance (EAS) and, more particularly, is concerned with filtering of signals received in EAS systems.

BACKGROUND OF THE INVENTION

It is well known to provide electronic article surveillance systems to prevent or deter theft of merchandise from retail establishments. In a typical system, markers designed to interact with an electromagnetic field placed at the store exit are secured to articles of merchandise. If a marker is brought into the field or "interrogation zone", the presence of the marker is detected and an alarm is generated. On the other hand, upon proper payment for the merchandise at a check-out counter, either the marker is removed from the article of merchandise or, if the marker is to remain attached to the article, then a deactivation procedure is carried out which changes a characteristic of the marker so that the marker will no longer be detected at the interrogation zone.

In one type of widely-used EAS system, the electromagnetic field provided at the interrogation zone alternates at a selected frequency and the markers to be detected include a magnetic material that produces harmonic perturbations of the selected frequency on passing through the field. Detection equipment is provided at the interrogation zone and is tuned to recognize the characteristic harmonic frequencies produced by the marker. If such frequencies are present, the detection system actuates an alarm. An EAS system of this type is disclosed, for example, in U.S. Pat. No. 4,660,025 (issued to Humphrey and commonly assigned with the present application).

It is often the case that EAS systems are deployed in locations at which substantial interfering electromagnetic signals are present. In addition to the usual 60 Hz radiation and harmonics generated by the building power system, other interfering signals are likely to be emanated from electronic cash registers, point-of-sale terminals, building security systems, and so forth. The presence of interfering signals can make it difficult to operate EAS systems in a satisfactory manner.

It is well known to adjust EAS systems among settings corresponding to greater or smaller degrees of sensitivity. When a system is adjusted so as to be relatively sensitive, the likelihood of permitting an EAS marker to pass through the interrogation zone undetected is decreased, but at the cost of possibly increasing susceptibility to false alarms. Conversely, if the sensitivity of the system is lowered, the propensity to false alarms is reduced, but the chance that a marker will pass through the interrogation zone undetected may be increased. Thus, adjustment of the EAS system often involves a tradeoff between reliable performance in terms of detecting markers (sometimes referred to as "pick rate") and susceptibility to false alarms. The presence of interfering signals tends to make it difficult to achieve an acceptably high pick rate without also incurring an unacceptable susceptibility to false alarms.

To overcome this problem, it has been known to perform certain signal conditioning or filtering upon the signal received by the detection equipment before that signal is processed to determine whether a marker is present in the interrogation zone. One approach that can be contemplated in terms of signal conditioning is comb band-pass filtering. A comb band-pass filter is designed to pass the harmonic signals generated by the marker, and to attenuate the noise spectrum in between the harmonic frequencies.

FIG. 1 is a block diagram illustration of hardware which constitutes an EAS system in which signal conditioning and marker detection is carried out by means of digital signal processing. Reference numeral 100 generally refers to the EAS system. The system 100 includes a signal generating circuit 112 which drives a transmitting antenna 114 to radiate an interrogation signal 116 into an interrogation zone 117. An EAS marker 118 is present in the interrogation zone 117 and radiates a marker signal 120 in response to the interrogation field signal 116. The marker signal 120 is received at a receiving antenna 122 along with the interrogation field signal 116 and various noise signals that are present from time to time in the interrogation zone 117.

The signals received at the antenna 122 are provided to a receiving circuit 124, from which the received signal is provided to a signal conditioning circuit 126. The signal conditioning circuit 126 performs analog signal conditioning, such as analog filtering, with respect to the received signal. For example, the signal conditioning circuit 126 may perform high-pass filtering with a cut-off frequency of about 600 Hz to remove the interrogation field signal 116, power line radiation, and low harmonics thereof. The signal conditioning circuit may also include a low-pass filter to attenuate signals above, say, 8 kHz, which is beyond the band which includes harmonic signals of interest.

The conditioned signal output from the signal conditioning circuit 126 is then provided to an analog-to-digital converter 128, which converts the conditioned signal into a digital signal, made up of a sequence of digital signal samples. The resulting digital signal is provided as an input signal to a digital signal processing device 130.

The DSP device 130 processes the input digital signal so as to provide additional signal conditioning and also in order to detect the presence of the marker signal 120. On the basis of such processing, the DSP device 130 determines whether a marker 118 seems to be present in the interrogation zone, and if so, the device 130 outputs a detection signal 132 to an indicator device 133. The indicator device 133 responds to the detection signal 132 by, for example, generating a visible and/or audible alarm or by initiating other appropriate action.

A comb band-pass filtering function provided by the DSP device 130 has a frequency-response characteristic as indicated by the solid line trace 134 in FIG. 2. The frequency-response characteristic represented by trace 134 would be suitable if the operating frequency $F_0$ (i.e., the frequency of the interrogation field signal 116) is 73.125 Hz, a commonly-used operating frequency in harmonic EAS systems. The pass-bands of the comb filtering function correspond to integral multiples of the operating frequency $F_0$, namely 73.125 Hz, 146.250 Hz, 219.375 Hz, and so forth. It will be observed that the frequency-response characteristic represented by trace 134 provides significant attenuation across the frequency spectrum between the transmitter harmonic frequencies, which are integral multiples of the operating frequency $F_0$. Accordingly, good attenuation of interfering signals can be obtained by providing comb filtering having this frequency-response characteristic before marker detection processing is performed.

FIG. 3 illustrates, in functional block form, processing carried out in DSP device 130 to implement the desired comb band-pass filtering. As shown in FIG. 3, a sequence of input digital signals x[n]is formed into M parallel sample streams at a block 136. Each of the resulting M subsequences is then respectively low-pass filtered as indicated by blocks 138. Typically the subsequence filters are implemented as infinite impulse response filters. After the low-pass filtering at the blocks 138, the parallel subsequences are synthesized at a block 140 into a sequence of output signals y[n] having the same sampling rate as the input signal x[n]. The number of subsequences, M, is obtained by dividing the sampling rate $F_S$ at which the A/D converter operates by the operating frequency $F_O$ (i.e., $M=F_S+F_O$). In a conventional harmonic EAS system, the sampling rate $F_S$ is 18.72 kHz, so that for an operating frequency $F_O$ =73.125 Hz, the number of subsequences M is 256.

The comb filtering processing illustrated in FIG. 3 is referred to as a multi-rate filter, and the formation of subsequences from the input signal is known as polyphase decomposition.

A comb band-pass filter implemented with a multi-rate architecture as shown in FIG. 3, and with pass bands corresponding to harmonic signals of interest in an EAS system can provide significant benefits in terms of attenuating interference which falls between the passbands. However, as pointed out in co-pending patent application Ser. No. 08/557,628 (filed Nov. 14, 1995, having the same inventors as the present application and commonly assigned with the present application), if impulsive or broad-band noise is present in the interrogation zone, the comb filter illustrated in FIG. 3 responds to such noise by "ringing", thereby generating a signal train that is produced in synchronism with the interrogation signal cycle and mimics the harmonic perturbations caused by markers. Such a signal train can easily be mistaken for a marker signal during subsequent marker detection processing, when in fact no marker is present.

To overcome this disadvantage of comb band-pass filtering, there was proposed in the aforesaid '628 patent application a practice which will now be described with reference to FIG. 4.

According to the practice disclosed in the '628 patent application, the input digital signal x[n] is provided as an input both to a comb filtering block 150, which has the frequency response indicated by trace 134 in FIG. 2, and also to an "anti-comb" filtering block 154, which has a frequency response indicated by the dashed-line trace 155 of FIG. 2. The "anti-comb" filtering function 154, like the comb filtering function 150, is a comb band-pass filter, but the pass bands of the "anti-comb" are positioned half-way between the pass bands of the comb filter 150.

A sequence of signals y[n] output from the comb filtering function 150 is subjected to marker detection processing at a block 152. If it is determined at block 152 that the output signal sequence y[n] is indicative of the presence of a marker signal 120 in the interrogation zone 117, then the block 152 generates the above-mentioned detection signal 132. The output sequence y[n] is also provided to a squaring function 156, the output of which is low pass filtered at block 160 and the resulting filtered signal is provided as a first input to a comparison block 164. An output sequence y' [n] resulting from the "anti-comb" filtering of the input signal at block 154 is also squared (block 158), low-pass filtered (block 162) and provided as a second input to the comparison block 164. The comparison block compares the two inputs, respectively received from the comb and "anti-comb" channels, and operates to inhibit the marker detection processing at block 152 when the inputs are substantially the same. The "anti-comb" processing channel of FIG. 4 serves to prevent false alarms in response to impulsive or broad-band noise, because the comb and anti-comb filtering functions respond to such noise by producing ringing in their respective outputs y[n] and y' [n] at essentially the same energy level. Consequently, when a noise impulse or broad-band noise is received, the two inputs to the comparison block are approximately equal, and marker detection processing is inhibited.

On the other hand, if a marker signal is received, most of the energy of the signal passes through the comb filtering function 150, but is blocked by the stop-bands of the anti-comb filter function 154. As a result, the input from the comb channel to comparison block 164 is much higher than the anti-comb channel input and marker detection processing is not inhibited.

The provision of the anti-comb impulsive noise detection channel to prevent false alarms that might otherwise be occasioned by use of comb filtering for signal conditioning represents an advance over conventional EAS practices, particularly because it thereby becomes practical to use a comb filter having steep transition bands without unduly increasing the system's susceptibility to false alarms. However, the provision of the anti-comb channel is not always an ideal solution to the problem of impulsive and broad-band noise. For example, in environments in which noise impulses occur relatively frequently, the anti-comb channel may inhibit marker detection processing quite often and/or over periods of significant duration, thereby leading to an undesirable reduction in "pick rate". Moreover, the comb filtering is not always as robust as would be desired in the face of non-Gaussian noise, and it may also be desirable to provide a filter that has a faster response time than can practically be provided with the type of comb filtering described above.

OBJECTIONS AND SUMMARY OF THE INVENTION

It is accordingly an object of the invention to provide an electronic article surveillance system in which signals received from an interrogation zone are filtered to suppress interference.

It is another object of the invention to provide an electronic article surveillance system which employs comb filtering in a manner that does not substantially contribute to susceptibility to false alarms.

It is still another object of the invention to provide an electronic article surveillance system in which comb filtering is employed and susceptibility to false alarms is reduced without also substantially reducing the likelihood of detecting marker signals.

It is yet another object of the invention to provide an electronic article surveillance system which employs a comb filter that has a faster response time than known comb filtering techniques.

It is still a further object of the invention to provide an electronic article surveillance system which employs a comb filtering function that is robust in the face of non-Gaussian interference.

According to an aspect of the invention, there is provided an electronic article surveillance system, including circuitry for generating and radiating an interrogation signal which alternates at a predetermined frequency $F_O$ in an interrogation zone, an antenna for receiving a signal present in the interrogation zone, an analog-to-digital converter for receiving an analog signal representative of the signal received by the antenna and for converting the analog signal into a sequence of digital samples, and digital signal processing circuitry for processing the sequence of digital samples to remove interference therefrom, where the digital signal processing circuitry processes the sequence of digital samples by forming M subsequences from the sequence of digital samples, M being a positive integer greater than 1, applying a respective nonlinear digital filtering function to each of the M subsequences, and combining the M filtered subsequences to form a processed sequence of digital samples.

Further in accordance with this aspect of the invention, the nonlinear filtering functions applied to the M subsequences may be such as would fall into the following classes of filtering functions, listed in order of decreasing generality: permutation filters, stack filters, and order-statistic filters. For example, the nonlinear filtering applied to the M subsequences may be implemented using a median filtering function, it being noted that a median filter is included in each of the three above-recited classes of filters.

It is further contemplated that the nonlinear filtering functions applied to the M subsequences could be a hybrid of linear and nonlinear filtering functions. For example, with respect to each subsequence, a median filtering function could be applied to outputs of a plurality of finite impulse response linear filtering functions applied to the subsequence.

In a particular embodiment of the invention, the number of subsequences (M) is established as the quotient obtained by dividing the sampling rate of the A/D converter by the system operating frequency $F_0$. For example, in a system which operates with a 73.125 Hz operating frequency and a sampling rate of 18.72 kHz, the number of subsequences M is established as 256.

It is further contemplated that the comb filtering technique summarized above, in which subsequences are nonlinearly filtered, could be used as a pre-filter so that the output of the multi-rate nonlinear comb filter would be provided as an input to a conventional linear comb band-pass filter. More specifically, where the nonlinear comb filter is used upstream from the linear comb filter, the processed sequence of digital samples output from the nonlinear comb filter would again be formed into M subsequences, and respective linear low-pass filtering functions would be applied to each of the M subsequences formed from the output of the nonlinear comb filter. Finally, the resulting linear-filtered subsequences would be combined to form a twice-processed sequence of digital samples.

The above-summarized practice, in which a multi-rate comb filter is implemented by nonlinear filtering of subsequences produced by a polyphase decomposition, makes it possible to provide a relatively fast comb bandpass filter that is substantially immune to impulsive noise and gracefully handles non-Gaussian noise distributions. As a consequence, there can be provided an EAS system with improved overall performance in terms of reliable detection of markers and reduced susceptibility to false alarms.

The foregoing and other objects, features and advantages of the invention will be further understood from the following detailed description of preferred embodiments and practices thereof and from the drawings, wherein like reference numerals identify like components and parts throughout.

DESCRIPTION OF PREFERRED EMBODIMENTS AND PRACTICES

Figure 1:
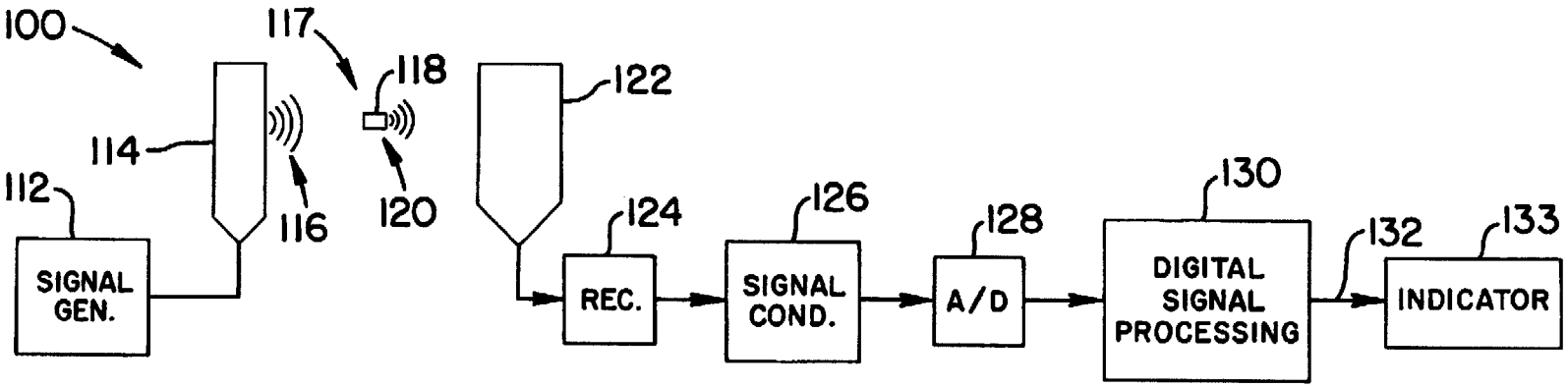
FIG. 1 is a schematic block diagram of hardware components which constitute an electronic article surveillance system in which the present invention is applied.

The teachings of the present invention may be embodied in an EAS system constituted by conventional hardware, such as that marketed by the assignee of the present application under the trademark "AISLEKEEPER". The digital signal processing described hereinafter may be carried out in a suitably programmed conventional digital signal processing integrated circuit, such as the model TMS-320C31, available from Texas Instruments. It is to be understood that the hardware arrangement illustrated in FIG. 1 is suitable for application of the signal processing teachings of the present invention.

Figure 4:
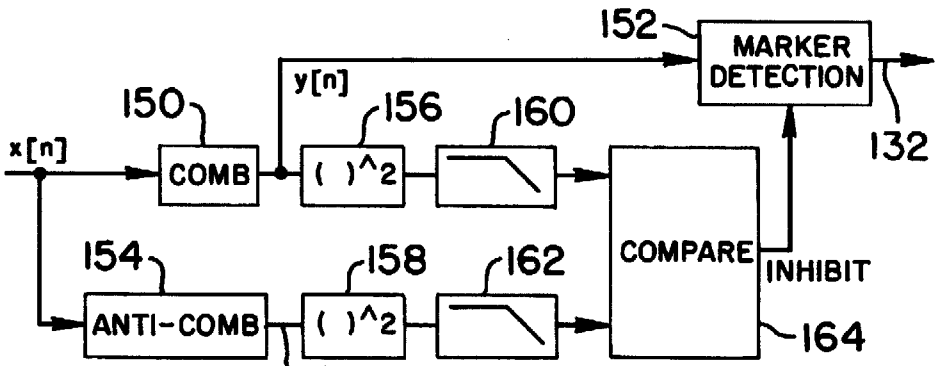
FIG. 4 illustrates in schematic block form signal processing functions carried out in accordance with teachings of the above-referenced co-pending patent application.
Figure 5:
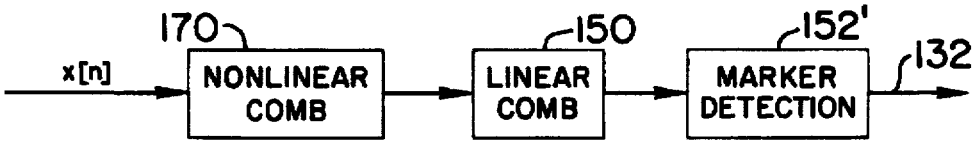
FIG. 5 is a functional block representation of signal processing to be carried out, in accordance with the invention, in the DSP device that is part of the apparatus of FIG. 1.

FIG. 5 is a high-level functional block representation of digital signal processing to be performed in accordance with the invention. As indicated in FIG. 5, a sequence of input samples x[n] is subjected to nonlinear comb filtering at a block 170 for the purpose of substantially removing impulsive noise, while also attenuating other noise that is between harmonic frequencies of interest. The signal output from the nonlinear comb filtering block 170 is then subjected to linear comb filtering at a block 150, which corresponds to the comb filtering block 150 described above in connection with FIG. 4. After the additional noise suppression for frequencies between the harmonic frequencies of interest provided by the block 150, the resulting conditioned signal is provided for marker detection processing to a marker detection block 152'. The block 152' may be the same as the block 152 discussed in connection with FIG. 4, except that there is no provision for selectively inhibiting marker detection (since no anti-comb processing channel is provided). As before, when the marker detection processing indicates that a marker signal is present in the interrogation zone, a detection signal 132 is generated.

Figure 6:
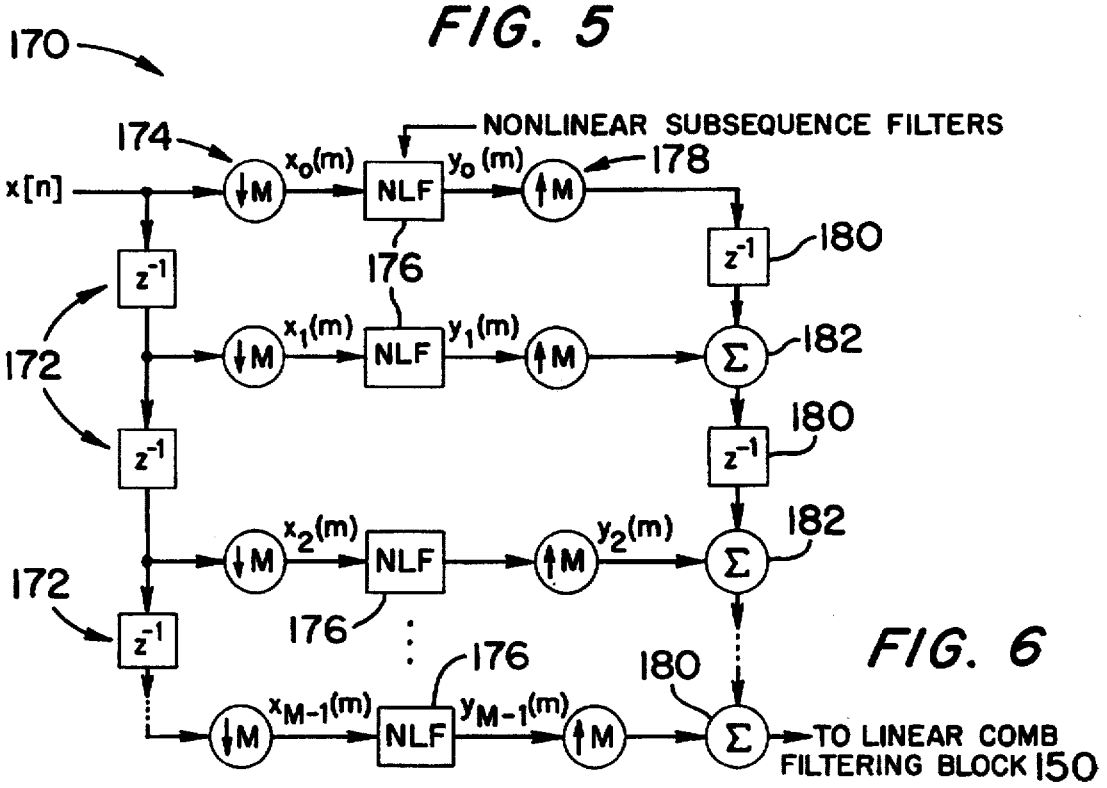
FIG. 6 is a schematic functional block representation of a nonlinear comb filtering function provided in accordance with the present invention.

FIG. 6 illustrates details of a preferred implementation of the nonlinear comb filtering function 170.

As seen from FIG. 6, the input sample sequence x[n]is subjected to an M-fold polyphase decomposition to form subsequences $x_0$ (m), $x_1$ (m), $x_2$ (m), . . . , $x_{M-1}$ (m). The concept of polyphase decomposition is discussed in Vaidyanathan, "Multirate Digital Filters, Filter Banks, Polyphase Networks, and Applications: A Tutorial," *Proceedings of the IEEE*, vol. 73, no. 1, January 1990, pp. 56–93.

The processing required to carry out the M-fold decomposition is represented by delay blocks 172 and M-fold decimation blocks 174. In a preferred implementation, the incoming samples x[n] are arrayed in a two-dimensional matrix, formed of M rows and as many columns as are needed for subsequent processing. Each incoming sample is placed in the matrix location in the same column and in the immediately following row relative to the location of the preceding sample, except that when the preceding sample was arrayed in the last row, the incoming sample is placed in the first row in the next column. Consequently, each of the rows of the data matrix corresponds to a respective one of the M subsequences. The number of subsequences, M, is obtained by dividing the sampling rate $F_S$ at which the sequence x[n] is formed, by the operating frequency $F_0$ of the system transmitter. In a preferred embodiment, M is calculated as 18.72 kHz÷73.125 Hz=256. Accordingly, in the preferred embodiment, the data matrix is formed of 256 rows.

Each of the subsequences is subjected to a respective nonlinear filtering function. In FIG. 6 the nonlinear subsequence filtering functions are represented by blocks 176. The purpose of the nonlinear filtering operations is to remove substantially all impulsive noise, and to attenuate other noise, in the subsequences $x_0$ (m) to $x_{M-1}$ (m). Examples of suitable nonlinear subsequence filters will be described below.

The filtered subsequences output from the nonlinear filter blocks 176 are then synthesized to form a nonlinear comb-filtered output sequence having the same sampling rate as the input sequence x[n]. As indicated in FIG. 6, the filtered subsequences $y_0$ (m), $y_1$ (m), $y_2$ (m) . . . , $y_{M-1}$ (m) are subjected to M-fold interpolation (up-sampling) at up-sampling blocks 178, and then the synthesis is performed by means of delay blocks 180 and summation blocks 182. However, according to a preferred practice, each signal cycle of the output sequence can be assembled by using the current value of $y_0$ (m) as the first sample of the signal cycle, the current value of $y_1$ (m) as the second sample of the signal cycle, and so forth, it being understood that each signal cycle is made up of M samples and corresponds to one cycle or frame of the interrogation signal.

Figure 7:
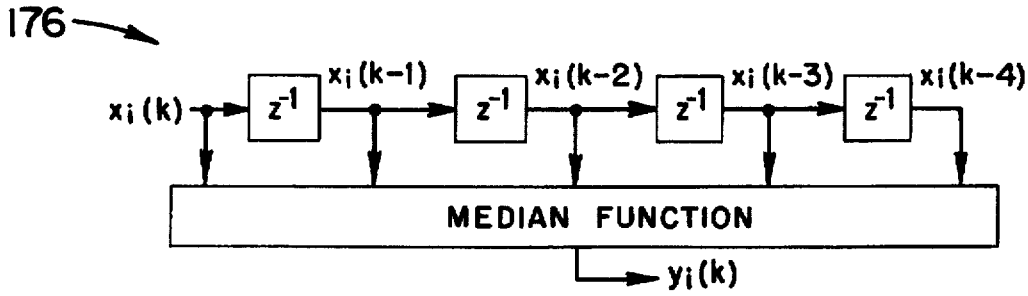
FIG. 7 is a schematic functional block representation of a median filtering function applied, in accordance with an aspect of the invention, to subsequences of digital samples formed by the polyphase decomposition process shown in FIG. 6.

FIG. 7 illustrates one example of a nonlinear filtering function that may be used to implement some or all of the nonlinear subsequence filters of FIG. 6. In particular, the function illustrated in FIG. 7 is a median filter of length L=5, where "length" is understood to refer to the number of inputs. The five inputs to the median function block are the five most recent samples of the subsequence, namely $x_i$ (k), $x_i$ (k–1), $x_i$ (k–2), $x_i$ (k–3) and $x_i$ (k–4). The values of the five input samples are rank ordered, i.e., sorted by amplitude, and the middle value (the third largest value) is output as $y_i$ (k).

According to one preferred embodiment of the invention, each of the nonlinear subsequence filters is a median filter of length L=5 shown in FIG. 7. However, it is also contemplated to use median filters of length L=3, or longer median filters. In general, it is to be understood that for a median filter of length L, the output of the subsequence median filtering function is obtained by rank ordering the values of the L inputs, and selecting as an output the (L+1)/2 th of the rank-ordered values as the output signal.

It is believed that the nonlinear comb filter illustrated in FIG. 6, when implemented with subsequence median filters of length L=3 or L=5, will provide satisfactory removal of impulsive noise and considerable attenuation of other noise, in most environments, while permitting the harmonic frequencies of interest to pass without attenuation. However, it is within the contemplation of this invention to use other types of nonlinear filtering processes for the nonlinear subsequence filters.

Median filters are included within a broader class of nonlinear filters known as "rank order" or "order statistic" filters. A definition of order statistic (OS) filters is provided in P. Maragos, et al., "Morphological Filters - Part II: Their Relations to Median, Order-Statistic, and Stack Filters," *IEEE Transactions on Acoustics, Speech, and Signal Processing*, Vol. ASSP-35, No. 8, August 1987, pp. 1170–1184. Instead of median filters, it is contemplated to use OS filters that are not median filters. One such filter, for example, would be an OS filter with a window length of five samples and which provides as an output the second or fourth ranking value from among the input values.

A still broader class of nonlinear filters, which includes all order statistic filters, is known as the class of "weighted order statistic" (WOS) filters. A definition of WOS filters is found in Yin, et al., "Fast Adaptation and Performance Characteristics of FIR-WOS Hybrid Filters," *IEEE Trans-*

*actions on Signal Processing*, Vol. 42, No. 7, July 1994, pp. 1610–1628. By referring to the discussion of WOS filters in the Yin, et al. article, those of ordinary skill in the art will recognize that, for example, many WOS filters may be designed which are not median filters but provide similar effects. It is also contemplated that WOS filters could be designed that are substantially different from median filters but still provide suitable subsequence processing to provide the desired nonlinear comb filter of FIG. 6.

Stack filters are still a broader class of nonlinear filters, weighted order statistic filters being a subset of stack filters. Stack filters can be implemented by applying certain classes of Boolean expressions to threshold decompositions of windowed sample sequences. A description of stack filters is found in Wendt, et al., "Stack Filters," *IEEE Transactions on Acoustics, Speech, and Signal Processing*, Vol. ASSP-34, No. 4, August 1986, pp. 898–911.

Still a broader class of nonlinear filters, of which stack filters are a subset, are permutation filters, which are based on set permutations. A definition of permutation filters is found in Barner, et al., "Permutation Filters: A Class of Nonlinear Filters Based on Set Permutations," *IEEE Transactions on Signal Processing*, Vol. 42, No. 4, April 1994, pp. 782–798.

It is within the contemplation of the invention to employ for the subsequence filters stack filters that are not weighted order-statistic filters, or permutation filters that are not stack filters. Use of such stack or permutation filters might, for example, be desirable if the noise present in the environment is such as to require longer filters, e.g., filters employing windows of as many as eleven samples. In such cases, it would be desirable to provide a stack filter or a permutation filter that would pass rather smooth pulses, and monotonically decreasing and increasing and constant sequences, while still rejecting sharp impulses.

Figure 8A:
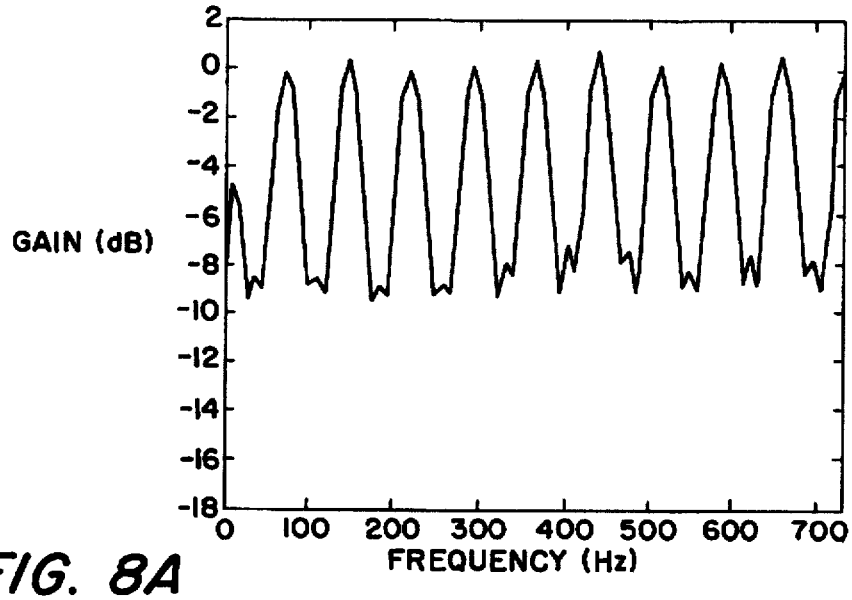
FIGS. 8A–8C are graphical representations of measured power spectra of output signals obtained by filtering white Gaussian noise with the nonlinear multi-rate filter of FIG. 6, where the subsequence filters were median filters of length L=3, L=5 and L=7, respectively.
Figure 8B:
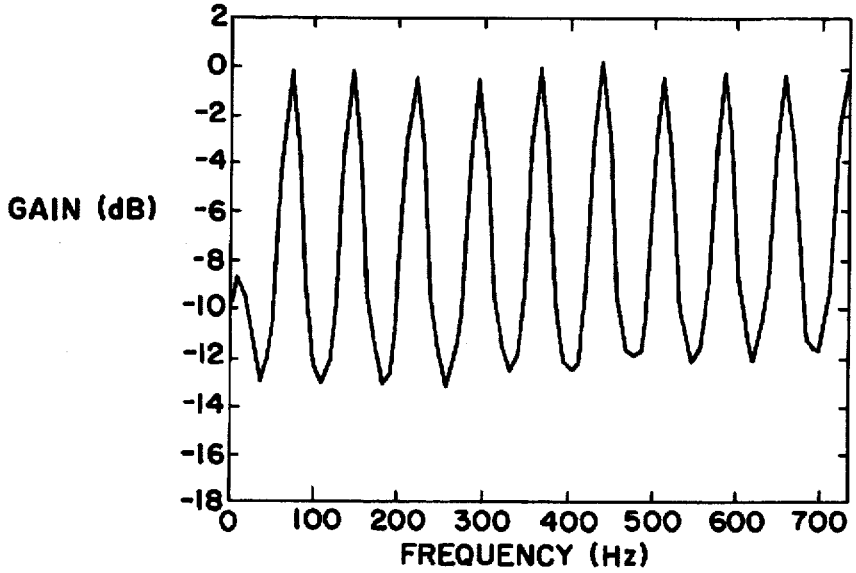
Figure 8C:
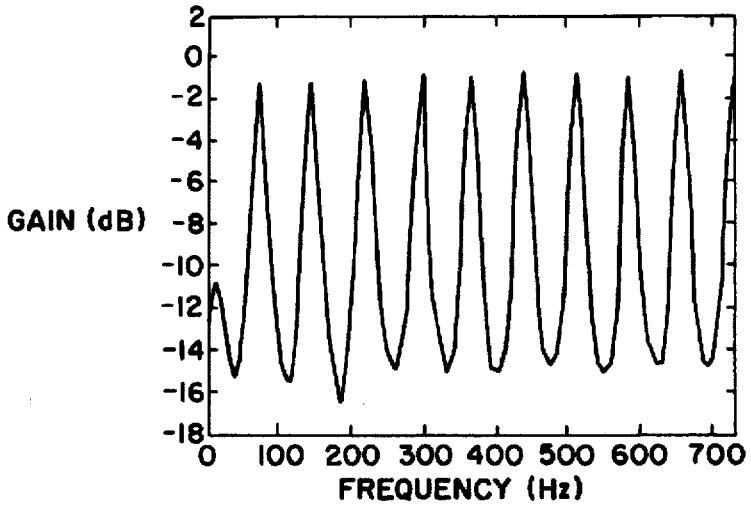

FIG. 8A shows the measured power spectrum of an output signal obtained by applying a zero mean, unit variance, white Gaussian noise signal as an input to the nonlinear comb filter of FIG. 6, where each of the subsequence filters is a median filter with L=3. (In all of the examples shown in FIGS. 8A–8C respectively, the number of subsequences M=256, and the sampling rate $F_S$=18.72 kHz.) FIG. 8B shows the measured power spectrum obtained by filtering the same noise signal where the subsequence filters are median filters with L=5, and FIG. 8C again shows a measured power spectrum where median filters with L=7 are used as the subsequence filters. It will be noted that the desired comb bandpass behavior is present, with substantial attenuation of energy between the harmonic frequencies of interest. If the input signal had a different distribution, the resulting output power spectrum could be quite different.

Figure 3:
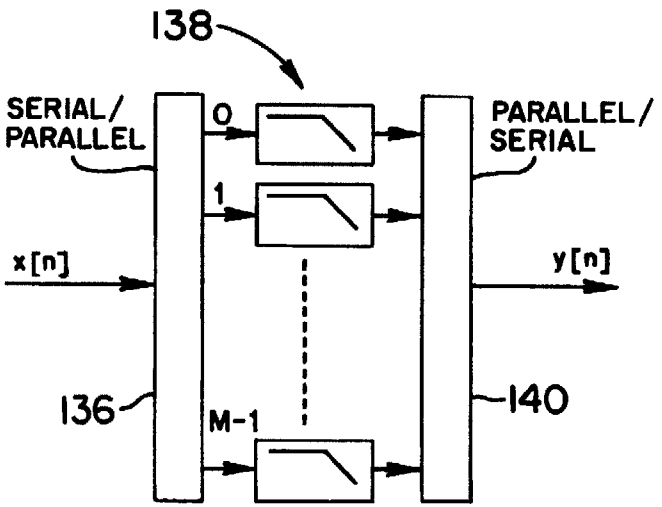
FIG. 3 is a schematic functional representation of a digital multi-rate implementation of a comb filtering function.
Figure 2:
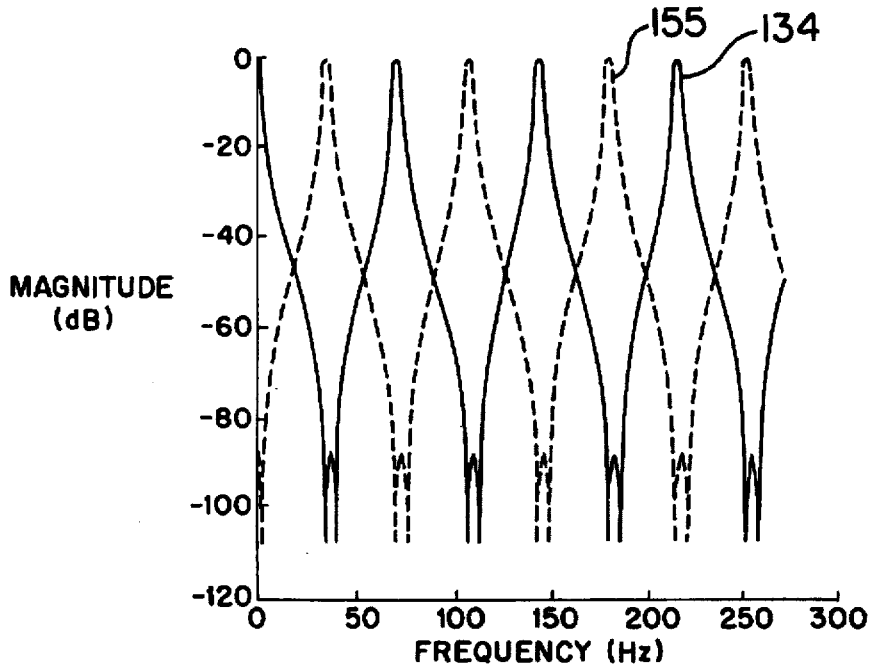
FIG. 2 graphically illustrates the respective frequency-response characteristics of first and second comb filtering processes described in a co-pending patent application having the same inventors as the present application.
Figure 9A:
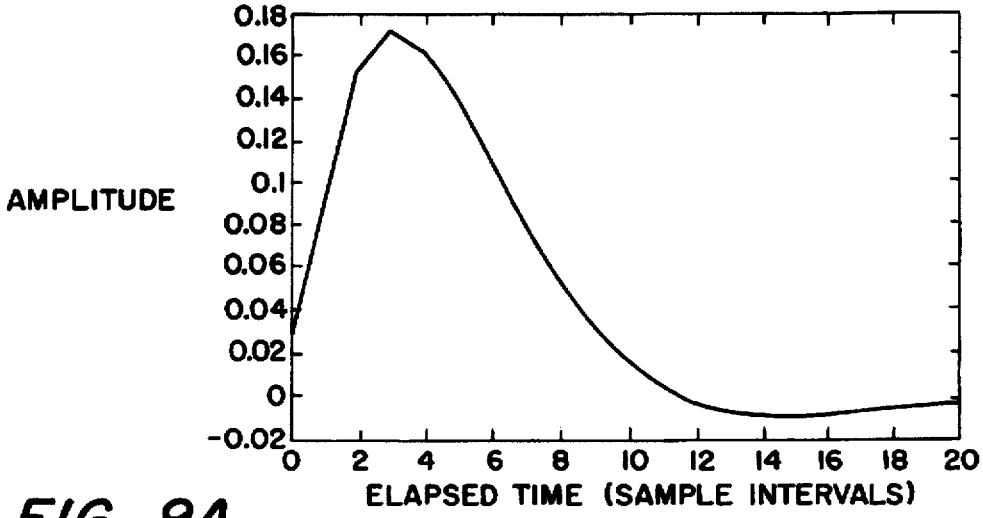
FIG. 9A is a graphical representation of the impulse response characteristic of a low pass filtering function that may be used as a subsequence filter in the multi-rate comb bandpass filter of FIG. 3.

It is also instructive to compare empirical results obtained with a median comb filter to analytical characteristics of a linear comb filter, such as that obtained by employing a low pass filter having the impulse response shown in FIG. 9A for the subsequence filters 138 of the linear comb filter shown in FIG. 3. The comparison is graphically illustrated in FIG. 9B over a frequency range from $F_0$ to $2F_0$ ($F_0$=73.125 Hz), where the traces 186 are representative of the frequency response of the linear comb filter over this frequency range, and trace 188 represents the measured output power spectrum (with white Gaussian noise as the input) for the median comb filter utilizing L=5 median subsequence filters (mentioned above in connection with FIG. 8B).

Figure 9B:
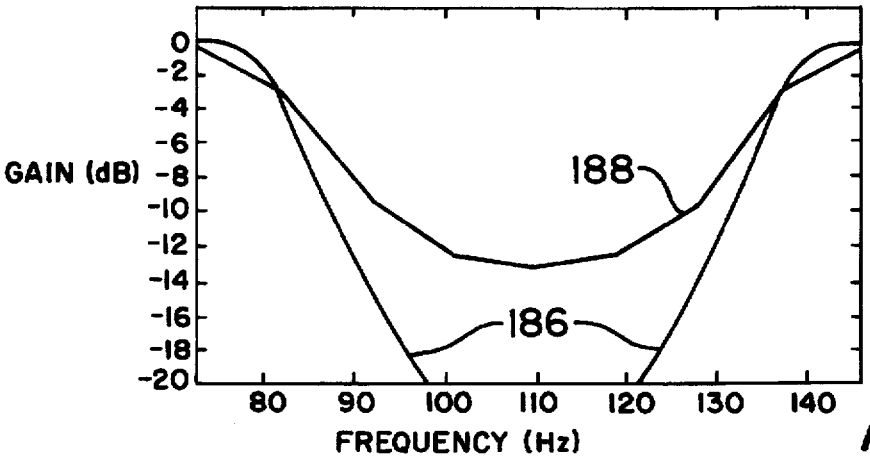
FIG. 9B is a graphical illustration of a comparison of a section of the frequency response characteristic of the multi-rate comb filter of FIG. 3 and a corresponding measured output spectrum of the nonlinear comb filter of FIG. 6, where the median filtering function of FIG. 7 is used to filter the subsequences of the filter of FIG. 6.

It will be observed from FIG. 9B that the linear comb filter provides substantially more attenuation between the pass bands than the attenuation applied to Gaussian noise by the median comb filter between $F_0$ and $2F_0$. Accordingly, as indicated in FIG. 5, it is preferred to provide a linear comb filter downstream from the nonlinear comb filter and prior to marker detection processing, in order to obtain greater attenuation of noise outside of the desired pass bands. For example, the linear comb filter 150 shown in FIG. 5 may be implemented using the above-mentioned linear subsequence filters having the impulse response shown in FIG. 9A. Because the nonlinear comb filter 170 removes substantially all impulsive noise, the linear comb filter 150 operates without the ringing problem described in the Background section of this application.

Where faster system response is desired, and less attenuation of noise between the pass bands can be tolerated, it is contemplated to omit the linear comb filter 150, and to use only the nonlinear comb filter 170.

There will now be described results of tests performed with respect to various test signals, comparing outputs of the nonlinear comb filter 170 with the linear comb filter 150.

Figure 10A:
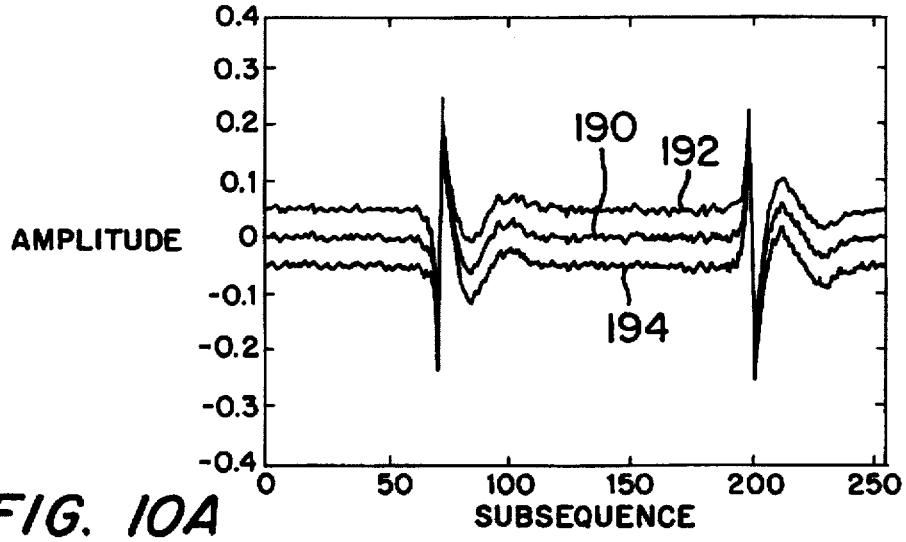
FIG. 10A is a graphical representation of a test signal formed by combining a marker signal with white Gaussian noise.
Figure 10B:
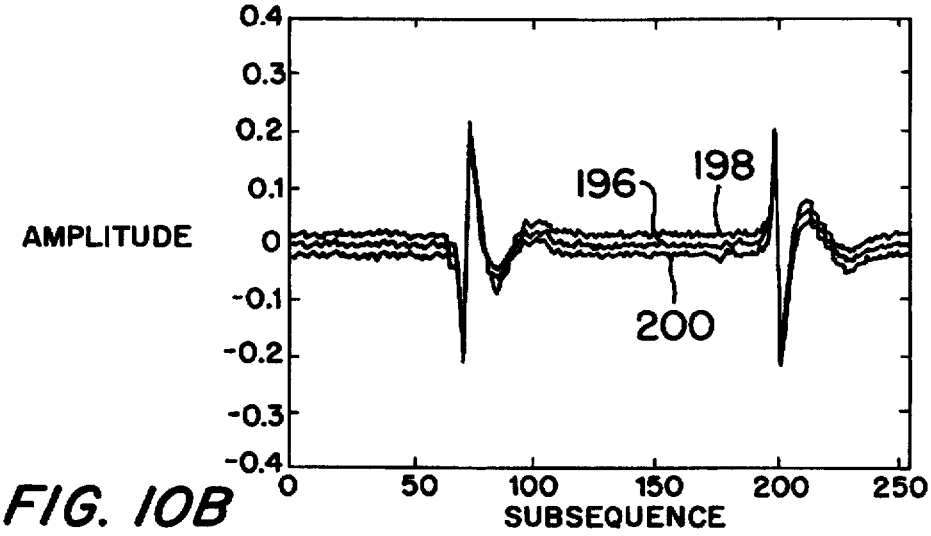
FIG. 10B is a graphical representation of an output obtained by linear comb filtering the test signal of FIG. 10A.

FIG. 10A illustrates statistics characteristic of a test signal formed by combining a marker signal with zero-mean white Gaussian noise. The duration of the test signal was approximately 3.5 seconds, and the statistics were compiled by subsequence, i.e., at 256 corresponding points in each cycle of the 73.125 Hz interrogation signal. In FIG. 10A, the bold trace 190 represents the mean of the test signal, and the traces 192 and 194 respectively represent plus and minus one standard deviation. FIG. 10B graphs the statistics of the output signal obtained by providing the test signal of FIG. 10A as an input to the above-described linear comb filter. Again, the bold trace 196 is the mean of the output signal, and the traces 198 and 220 respectively represent plus and minus one standard deviation.

Figure 10C:
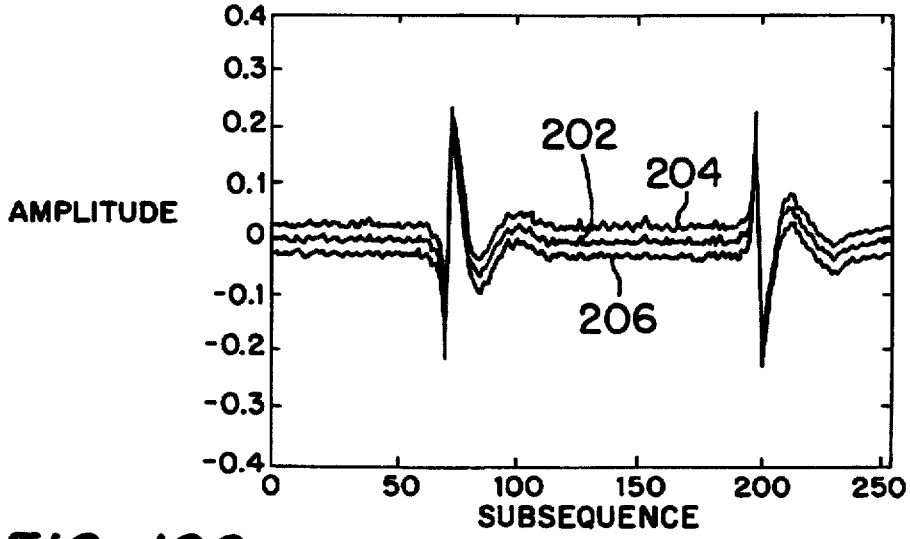
FIG. 10C is a graphical representation of an output obtained by median comb filtering the test signal of FIG. 10A.

FIG. 10C graphs the statistics of an output signal obtained by applying the test signal of FIG. 10A as an input to a median comb filter, where each of the subsequences is filtered with a median filter of L=5. Once again, the bold trace 202 represents the mean, and traces 204 and 206 respectively represent plus and minus one standard deviation of the median comb filter output. A comparison of FIGS. 10B and 10C with the test signal itself (FIG. 10A) indicates that both the linear and nonlinear comb filter reduce the variance, but the linear comb filter performs somewhat better.

Figure 11A:
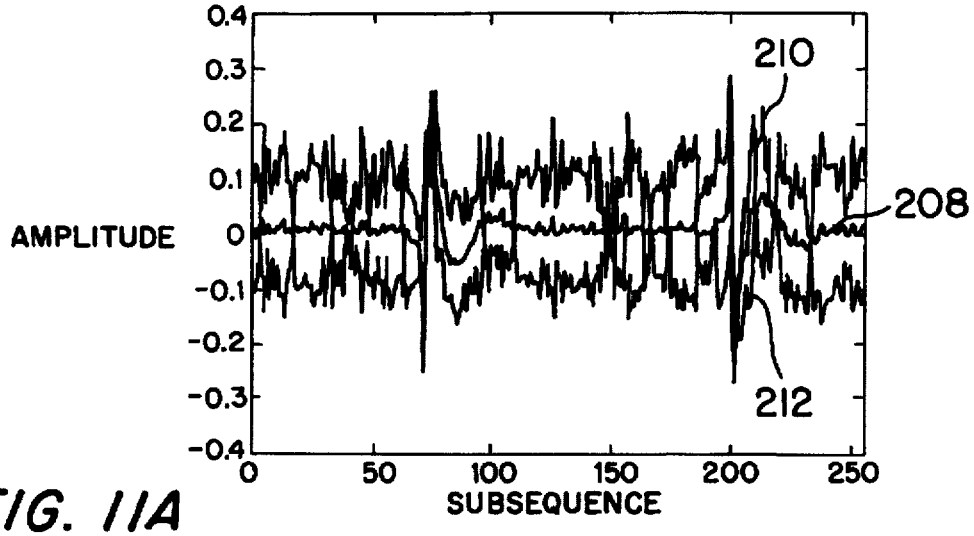
FIG. 11A is a graphical representation of a test signal obtained by combining a marker signal with impulsive noise.

FIG. 11A illustrates statistics of a second test signal, obtained by adding a marker signal with impulsive noise. The impulsive noise was independent, identically distributed with a probability of a pulse occurring P=0.01. The impulses have a Gaussian distribution with mean equal to 1.1 and a variance of 0.25. Again FIG. 11A shows a mean (trace 208) and plus or minus one standard deviation (traces 210 and 212).

Figure 11B:
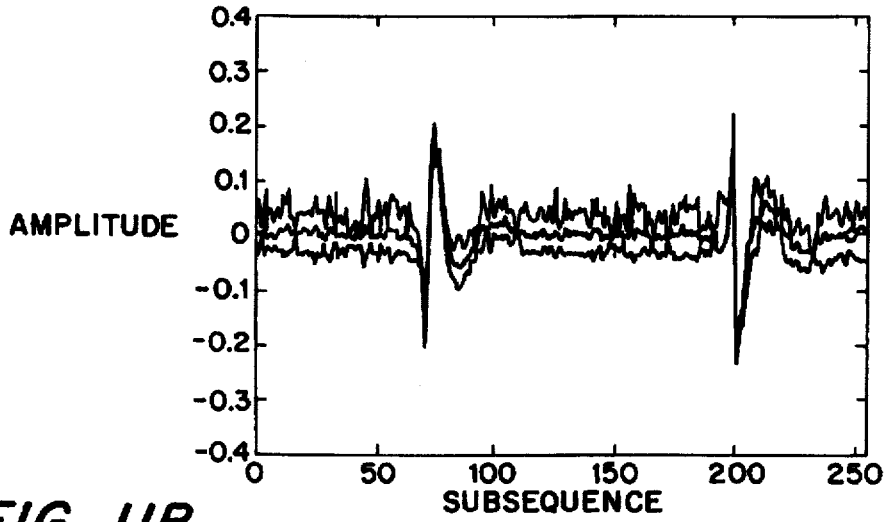
FIG. 11B is a graphical representation of an output obtained by linear comb filtering the test signal of FIG. 11A.
Figure 11C:
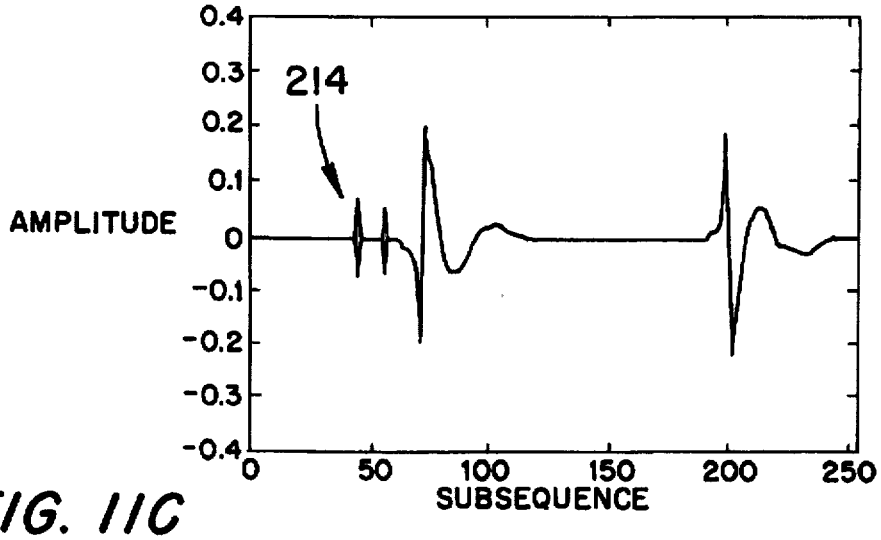
FIG. 11C is a graphical representation of an output obtained by median comb filtering the test signal of FIG. 11A.

FIGS. 11B and 11C respectively illustrate statistics of output signals obtained by filtering the test signal of FIG. 11A with the linear and median comb filters. From FIG. 11C, it will be seen that the median filter has performed much better, eliminating substantially all of the impulses except as indicated at 214.

Figure 12A:
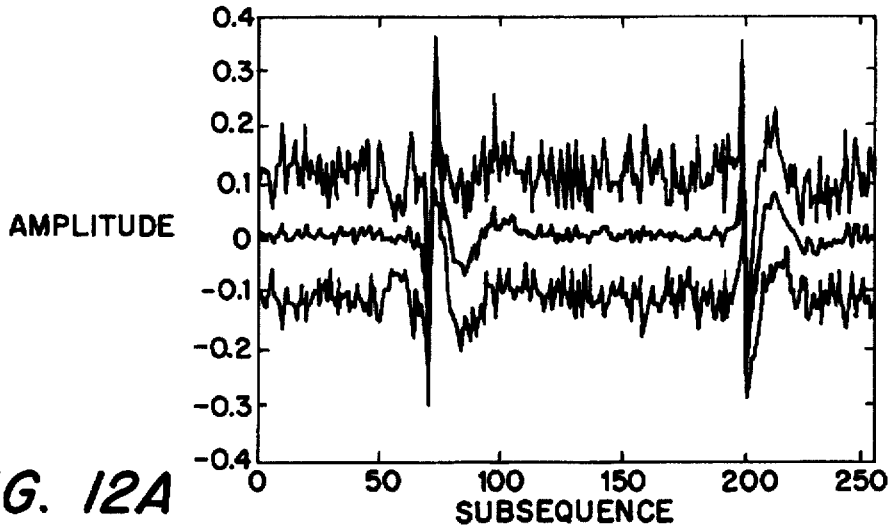
FIG. 12A is a graphical representation of a test signal obtained by combining a marker signal with both impulsive noise and white Gaussian noise.
Figure 12B:
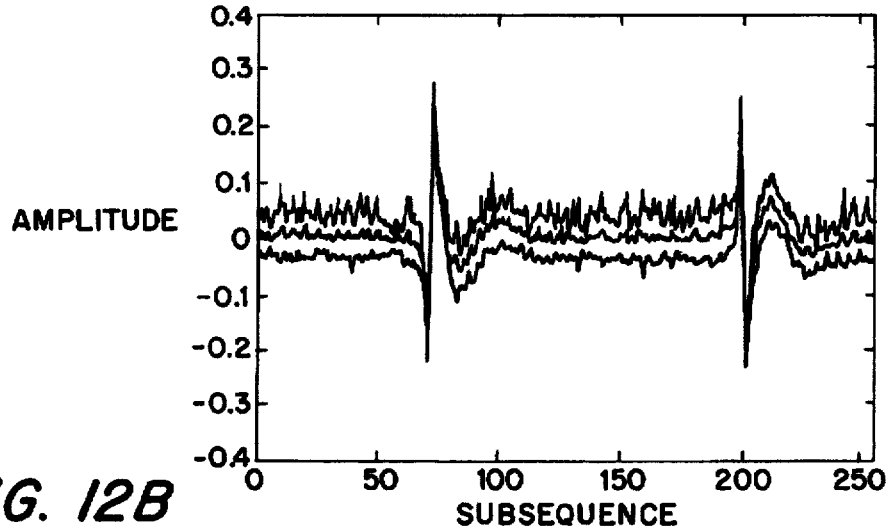
FIG. 12B is a graphical representation of an output obtained by linear comb filtering the test signal of FIG. 12A.
Figure 12C:
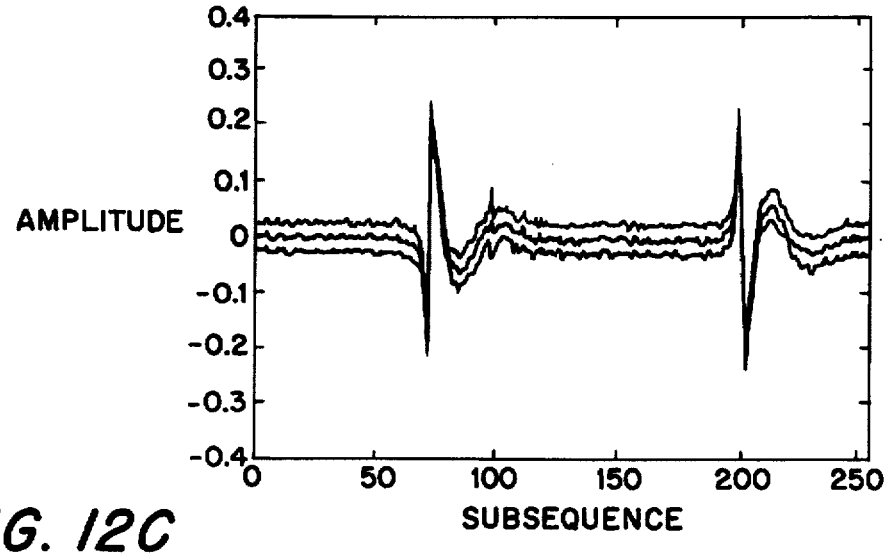
FIG. 12C is a graphical representation of an output obtained by median comb filtering the test signal of FIG. 12A.

FIG. 12A illustrates another test signal, obtained by combining both the Gaussian noise and the impulsive noise described above with a marker signal. FIGS. 12B and 12C illustrate the outputs, respectively, of the linear comb filter and the median comb filter. Again it will be observed that better performance is obtained with the median comb filter.

In the nonlinear filter used for the tests just described, the same nonlinear filtering function, namely a median filter with L=5, was used to filter each of the subsequences. However, it is contemplated to use nonlinear filtering functions that vary from subsequence to subsequence. For example, an adaptive order statistic filter, like that described in Haweel, et al., "A Class of Order Statistic LMS Algorithms", *IEEE Transactions on Signal Processing*, Vol. 40, No. 1, January 1992 (pp. 44–53), could be used to filter each subsequence. In such a case, if the subsequences exhibit different characteristics, the effective filtering performed by the respective adaptive subsequence filters will be different.

Moreover, if there is a priori knowledge of the characteristics of the various subsequences, suitable nonlinear filtering functions for each subsequence can be provided. For example, a median filter with L=3 could be used for some sequences and a median filter with L=5 used for other subsequences. Such a practice might be appropriate where subsequences near the peaks of the interrogation signal exhibit different noise characteristics from other subsequences. It might also be appropriate to use nonlinear filters that vary from subsequence to subsequence if the interrogation signal is at the same frequency as, or is related to, the power line frequency.

Up to this point, the nonlinear filtering functions proposed for use as subsequence filters have all fallen within the broad general class of permutation filters. A characteristic of permutation filters is that the value of each output sample is constrained to be the value of an input sample. However, it is also contemplated to form a comb filter in which the subsequence filters are a hybrid of linear and nonlinear filters. For example, a FIR-median hybrid filter, like that shown in FIG. 13 and discussed in Heinonen, et al., "FIR-Median Hybrid Filters", *IEEE Transactions on Acoustics Speech and Signal Processing*, Vol. ASSP-35, No. 6, June 1987, pp. 832–838, could be used as a subsequence filter. In the hybrid filter illustrated in FIG. 13, it will be observed that a plurality of finite impulse response (linear) filters are provided, each operating on a respective window of the input sequence, with the windows being non-overlapping. The median of the outputs from the FIR filters is provided as the output of the hybrid filtering function. (Since preservation of sharp edges is not important for the implementation of the nonlinear comb filter, it is not necessary for the central one of the FIR filters to have an output equal to one, as is indicated in the example given in the Heinonen, et al. paper.)

It is also contemplated to use as a subsequence filter a hybrid filter in which outputs of plural nonlinear (e.g., median filters) are subjected to linear filtering (e.g., FIR).

Figure 13:
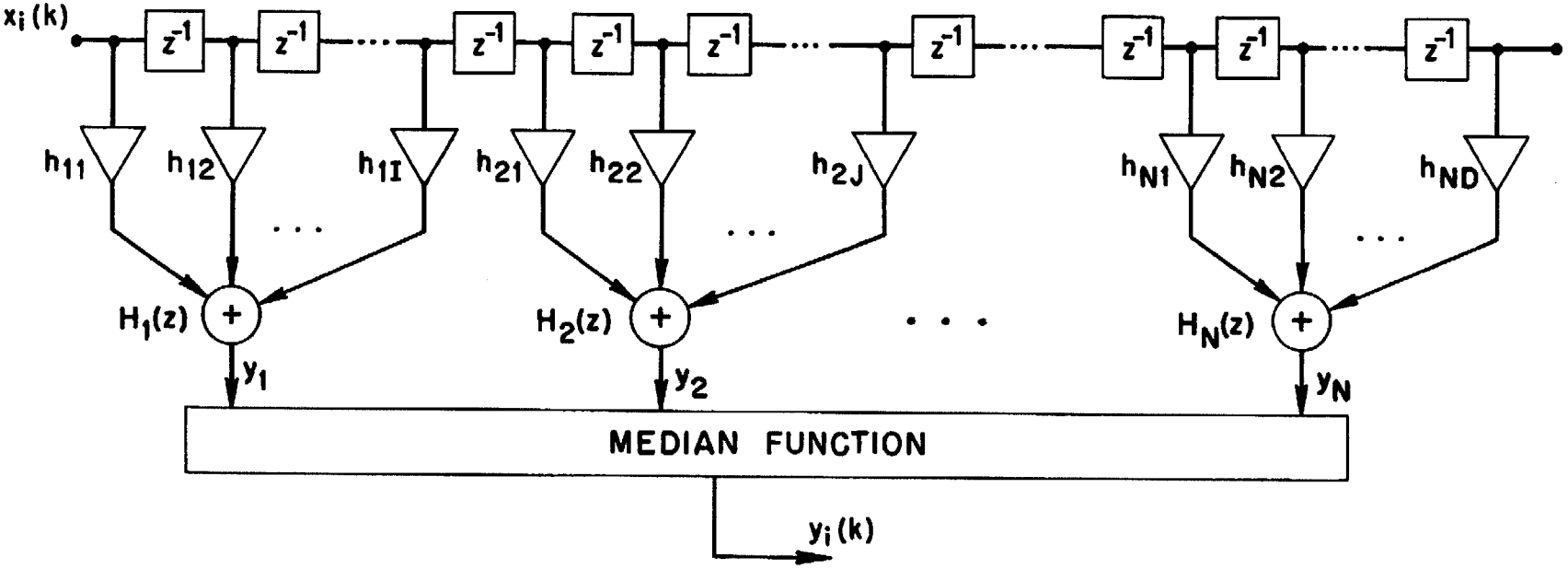
FIG. 13 is a schematic functional block representation of a FIR-median hybrid filtering function that may be employed, according an aspect of the invention, to filter the subsequences formed by the polyphase decomposition shown in FIG. 6.

It is believed that a nonlinear comb filter implemented using subsequence filters of the type shown in FIG. 13 would produce results that are comparable to those obtained by the cascading of the nonlinear comb filter 170 and the linear comb filter 150 as shown in FIG. 5.

By providing a nonlinear comb filter upstream from, or instead of, a linear comb filter, it is possible to provide advantageous digital signal conditioning in an EAS system, without suffering an increase in false alarms due to ringing that would otherwise be stimulated by the effect of impulsive noise on the linear comb filter.

Various changes in the foregoing apparatus and modifications in the described practices may be introduced without departing from the invention. The particularly preferred methods and apparatus are thus intended in an illustrative and not limiting sense. The true spirit and scope of the invention is set forth in the following claims.

What is claimed is:

1. An electronic article surveillance system, comprising:

means for generating and radiating an interrogation signal which alternates at a predetermined frequency $F_0$ in an interrogation zone;

antenna means for receiving a signal present in the interrogation zone;

A/D conversion means for receiving an analog signal representative of said signal received by said antenna means and converting said analog signal into a sequence of digital samples; and digital signal processing means for processing said sequence of digital samples to remove interference therefrom, said digital signal processing means processing said sequence of digital samples by:

forming M subsequences from said sequence of digital samples, M being a positive integer greater than 1;

applying a respective nonlinear digital filtering function to each of said M subsequences; and combining the M filtered subsequences to form a processed sequence of digital samples.

2. An electronic article surveillance system according to claim 1, wherein each of said nonlinear filtering functions applied to said M subsequences is a permutation filtering function.

3. An electronic article surveillance system according to claim 2, wherein each of said nonlinear filtering functions applied to said M subsequences is a stack filtering function.

4. An electronic article surveillance system according to claim 3, wherein each of said nonlinear filtering functions applied to said M subsequences is an order-statistic filtering function.

5. An electronic article surveillance system according to claim 4, wherein each of said nonlinear filtering functions applied to said M subsequences is a median filtering function.

6. An electronic article surveillance system according to claim 5, wherein each of said median filtering functions provides as an output the second largest value from among the three most recent samples of the respective subsequence.

7. An electronic article surveillance system according to claim 5, wherein each of said median filtering functions provides as an output the third largest value from among the five most recent samples of the respective subsequence.

8. An electronic article surveillance system according to claim 1, wherein each of said nonlinear filtering functions applied to said M subsequences is a hybrid of linear and nonlinear filtering functions.

9. An electronic article surveillance system according to claim 8, wherein each of said nonlinear filtering functions applied to said M subsequences is performed by applying a median filtering function to outputs of a plurality of finite impulse response linear filtering functions applied to the respective subsequence.

10. An electronic article surveillance system according to claim 1, wherein all of said nonlinear filtering functions applied to said M subsequences are identical.

11. An electronic article surveillance system according to claim 1, wherein at least some of said nonlinear filtering functions applied to said M subsequences are adaptive filtering functions.

12. An electronic article surveillance system according to claim 1, wherein said A/D conversion means forms said digital samples at a sampling rate $F_S$ and $M=F_S/F_0$.

13. An electronic article surveillance system according to claim 12, wherein $F_S$ =18.72 kHz, $F_0$ =73.125 Hz and M=256.

14. An electronic article surveillance system according to claim 1, wherein said digital signal processing means further processes said processed sequence of digital samples by:

forming M subsequences from said sequence of processed digital samples;

applying a respective linear low-pass filtering function to each of said M subsequences formed from said sequence of processed digital samples; and combining the M linear-filtered subsequences to form a twice-processed sequence of digital samples.

15. A method of removing interference from a signal received by an electronic article surveillance system, comprising the steps of:

generating and radiating an interrogation signal which alternates at a predetermined frequency $F_0$ in an interrogation zone;

receiving an analog signal representative of a signal present in the interrogation zone and converting the received analog signal into a sequence of digital samples; and processing said sequence of digital samples to remove interference therefrom, said processing step including:

forming M subsequences from said sequence of digital samples, M being a positive integer greater than 1;

applying a respective nonlinear digital filtering function to each of said M subsequences; and combining the M filtered subsequences to form a processed sequence of digital samples.

16. A method according to claim 15, wherein each of said nonlinear filtering functions applied to said M subsequences is a permutation filtering function.

17. A method according to claim 16, wherein each of said nonlinear filtering functions applied to said M subsequences is a stack filtering function.

18. A method according to claim 17, wherein each of said nonlinear filtering functions applied to said M subsequences is an order-statistic filtering function.

19. A method according to claim 18, wherein each of said nonlinear filtering functions applied to said M subsequences is a median filtering function.

20. A method according to claim 19, wherein each of said median filtering functions provides as an output the second largest value from among the three most recent samples of the respective subsequence.

21. A method according to claim 19, wherein each of said median filtering functions provides as an output the third largest value from among the five most recent samples of the respective subsequence.

22. A method according to claim 15, wherein each of said nonlinear filtering functions applied to said M subsequences is a hybrid of linear and nonlinear filtering functions.

23. A method according to claim 22, wherein each of said nonlinear filtering functions applied to said M subsequences is performed by applying a median filtering function to outputs of a plurality of finite impulse response linear filtering functions.

24. A method according to claim 15, wherein all of said nonlinear filtering functions applied to said M subsequences are identical.

25. A method according to claim 15, wherein at least some of said nonlinear filtering functions applied to said M subsequences are adaptive filtering functions.

26. A method according to claim 15, wherein said digital samples are formed at a sampling rate $F_S$ and $M=F_S/F_O$.

27. A method according to claim 26, wherein $F_S$ =18.72 kHz, $F_O$ =73.125 Hz and M=256.

28. A method according to claim 15, further comprising the step of second-processing the processed sequence of digital samples, said second-processing step including:

forming M subsequences from said sequence of processed digital samples;

applying a respective linear low-pass filtering function to each of said M subsequences formed from said sequence of processed digital samples; and combining the M linear-filtered subsequences to form a twice-processed sequence of digital samples.

29. An electronic article surveillance system, comprising:

means for generating and radiating an interrogation signal which alternates at a predetermined frequency in an interrogation zone;

antenna means for receiving a signal present in the interrogation zone;

A/D conversion means for receiving an analog signal representative of said signal received by said antenna means and converting said analog signal into a sequence of digital samples; and digital signal processing means for processing said sequence of digital samples to remove interference therefrom, said digital signal processing means processing said sequence of digital samples by:

performing a polyphase decomposition to form a plurality of subsequences from said sequence of digital samples;

applying a respective nonlinear digital filtering function to each of said plurality of subsequences; and synthesizing the filtered subsequences to form a processed sequence of digital samples.

30. An electronic article surveillance system according to claim 29, wherein at least some of the nonlinear filtering functions applied to the subsequences are median filtering functions.

31. An electronic article surveillance system according to claim 30, wherein all of the nonlinear filtering functions applied to the subsequences are median filtering functions.

* * * * *

UNITED STATES PATENT AND TRADEMARK OFFICE

CERTIFICATE OF CORRECTION

PATENT NO. : 5,673,024

DATED : September 30, 1997

INVENTOR(S) : Frederick et al.

It is certified that error appears in the above-identified patent and that said Letters Patent is hereby corrected as shown below:

Col. 2, line 40, delete "0n" and insert -- On --.

Signed and Sealed this

Third Day of March, 1998

*Attest:*

Bruce Lehman

BRUCE LEHMAN

*Attesting Officer*

*Commissioner of Patents and Trademarks*